US005701718A

United States Patent [19]

Spada

[11] Patent Number: 5,701,718

[45] Date of Patent: Dec. 30, 1997

[54] PROCESSING MACHINE, PARTICULARLY A PACKING MACHINE FOR CIGARETTES OR SIMILAR

[75] Inventor: Valter Spada, Marzabotto, Italy

[73] Assignee: Sasib S.p.A., Bologna, Italy

[21] Appl. No.: 684,208

[22] Filed: Jul. 19, 1996

[30] Foreign Application Priority Data

Aug. 2, 1995 [IT] Italy ..... GE95A0086

[51] Int. Cl.[6] ..... B65B 19/02; B65B 59/04

[52] U.S. Cl. ..... 53/201; 53/148; 53/203; 53/228

[58] Field of Search ..... 53/228, 203, 466, 53/461, 168, 201, 148; 493/478, 477, 473, 480

[56] References Cited

U.S. PATENT DOCUMENTS

| | | | |
|---|---|---|---|
| 4,751,805 | 6/1988 | Walter | 53/201 X |
| 4,807,420 | 2/1989 | Barker | 53/201 X |
| 4,999,979 | 3/1991 | Vicq | 53/201 X |
| 5,123,227 | 6/1992 | Shibauchi et al. | 53/201 |

FOREIGN PATENT DOCUMENTS

| | | |
|---|---|---|
| 0 113 874 | 12/1983 | European Pat. Off. . |
| 0 645 307 | 3/1993 | European Pat. Off. . |
| 2 115 656 | 10/1972 | Germany . |
| 27 28 759 | 1/1979 | Germany . |
| 2 048 814 | 12/1980 | United Kingdom . |

*Primary Examiner*—James F. Coan
*Attorney, Agent, or Firm*—Larson & Taylor

[57] ABSTRACT

A processing machine, particularly a packing machine for cigarettes or similar, includes a plurality of operating units which execute various steps of processing which are synchronized with each other and follow a predetermined system of operation. The machine has a modular unit construction, consisting of a table or bed (1) which forms a horizontal, or substantially horizontal, plane (101) acting as an upper support for the various operating units (2, 3, 4, 5, 6, 7, 10, 11, 12, 13, 14, 15, 16, 17, 18) and lower housings (201, 301) for further operating units (20, 22, 23, 25, 26, 27, 28), all the operating units being made in prefabricated form.

11 Claims, 16 Drawing Sheets

17
115
15
514
414
215
315
12
415
9'
14
9
104
204
104
114
211
314
411
404
311
106
511
304
111
25
611
23
28
28
120
21
28
201
22
28
20
320
301
26
1

2
202
404'
402
5
304
4
104
204
105
25
101
201
1
28
27
21
120
301
20
320
28
26

10
410
310
210
9
9'

15
515
215
315
415
115
112
12

PROCESSING MACHINE, PARTICULARLY A PACKING MACHINE FOR CIGARETTES OR SIMILAR

The invention relates to a processing machine, particularly a packing machine for cigarettes or similar, this processing machine comprising a plurality of operating units which execute various steps of processing which are synchronized with each other and follow a predetermined system of operation.

At the present time, machines used in particular in the tobacco product industry, such as cigarette packing machines or other, consist of a large number of operating units which operate in synchronization with each other and at very high speeds. The operating units are generally mounted in monolithic supporting or housing structures in the form of cabinets. This type of construction is not only less rational in terms of the logic of the machines' operations, but also requires considerable effort for the making of the parts, their assembly, and the subsequent maintenance, repair and replacement and also for simple transport and the subsequent stage of assembly and commissioning.

The object of the invention is to provide a processing machine of the type described initially such that it has a construction which makes its assembly more rational, simple, and inexpensive, while providing a greater ease of maintenance, repair and replacement of the working parts and reducing the number of machine parts integrated in a monolithic bed structure.

The invention achieves the above objects with a processing machine, particularly a packing machine of the type described initially, which has a modular unit construction, consisting of a table or bed which forms a horizontal, or substantially horizontal, plane acting as an upper support for the various operating units and lower housings for further prefabricated operating units.

The prefabricated operating units are integrated in structures or enclosed in casings which have means of fixing in predetermined positions, while the bed has complementary and coincident means of fixing disposed in a predetermined way and at predetermined points for each operating unit.

Each operating unit consists of at least one drive unit, one or more units for conversion, transfer and distribution of the motion from the drive unit to prefabricated members, having removable means of coupling such as powered drive shafts, and static and/or free-running supports, guides or bearings such as idle shafts, to the sources of motion of the units for conversion, transfer and distribution of the motion.

The drive units and the units for conversion, transfer and distribution of the motion consist of boxes which are fixed in a predetermined position above or below the plane of the bed, while the operating members are pre-assembled on means of coupling to the sources of motion of the units for conversion, transfer and distribution of the principal motion.

The layout of the machine may advantageously be such that one of the longitudinal sides of the bed forms the front face, while the opposite side forms the rear face, the principal drive units being disposed in a position nearer the rear face of the bed, while the units for conversion, transfer and distribution of the motion are provided in a substantially intermediate position and the operating members are disposed in front or operate in a forward position in the area of the front face of the bed.

The operating units and principal drive units, as well as the units for conversion, transfer and distribution of the motion, are advantageously disposed in such a way that, during their processing, the parts being processed are moved in two directions, one in the longitudinal direction of the bed from one end to the opposite end and parallel to the front face and the other in the direction transverse to the front face of the bed and always in the direction of the front face of the bed. In this way, the path is subdivided into individual longitudinal segments which are provided from the initial end of the path to its terminal end progressively on planes out of alignment with each other and always in the direction of the front face.

According to a further characteristic of the invention, the individual operating units may be coupled together by means of removable coupling means of the clutch or tightening type.

In the processing of parts which produce waste dust, shavings, or similar, at least one or more parts of the plane of the bed, particularly those located under the operating units where the waste is produced, consist of conveyor means for collecting the waste, and in particular conveyor belts which terminate at the ends of the bed where means of collection may be provided and are preferably substantially coplanar with the plane of the bed.

When the processing requires the combining of the products with additional materials, for example in operations of wrapping and packing, it is possible to form two independent areas for the processing and feeding of the parts and of the additional material, with paths which converge towards the operating unit for combining the parts with the additional material. In this case, the parts are processed and/or handled on paths substantially above the plane of the bed, while the additional material is handled and/or processed on paths substantially underneath the plane of the bed, the operating units for processing the parts and combining them with the additional material being provided above the plane of the bed and the operating units for feeding and preparing the additional material being housed in voids underneath the plane of the bed.

The inventive concept is applicable to any type of processing machine.

The invention also has a particular embodiment consisting of a cigarette packing machine.

In this case, the machine consists of:

a table or bed with a completely free horizontal plane;

at least one box containing one or more principal motors and the transmission systems of the first stage of transmission and distribution of the principal motion to a plurality of driving shafts projecting from the front face of the box, the box being fixed in the area of the rear face to the plane of the bed;

a plurality of boxes for conversion, transmission and distribution of the motion, which are supported on and fixed to the plane of the bed in an intermediate position of the plane between the rear face and the front face of the bed and in front of the drive box or boxes, and which have input shafts or other means of transmission of the motion which are provided with means, preferably of the socket or clutch type, for removable coupling with at least one or more of the output shafts of the drive unit;

a plurality of pre-assembled operating members consisting of mechanical structures which have input shafts or other means of transmission of the motion and idle guide shafts or to other idle guide means which can be coupled removably to the output shafts or to other sources of motion and to static and/or idle shafts or to other static and/or idle guide supports projecting from the front faces of the boxes of the corresponding units for conversion, transfer and distribution of the motion.

According to a further characteristic, some units for conversion, transfer or distribution of the motion, particularly those disposed so that they do not face the drive unit, may derive their motion not directly from the principal motor but from units for conversion, transfer and distribution of the motion located beside, above or below them, one unit being provided with sources of motion and the other with members for distributing the motion which can be coupled removably to the former.

The packing machine advantageously has on the entry side a unit for feeding cigarettes in an ordered state, which converts a random and substantially continuous flow into a discontinuous flow of groups of cigarettes in a predetermined order, a unit for forming and feeding ordered groups of cigarettes to a subsequent unit for transferring each ordered group of cigarettes and combining it with a wrapping slip, a unit for folding the wrapping slip around the associated ordered group of cigarettes, a unit for feeding and preparing the wrapping slips from a continuous strip which is unwound from a reel, and means of feeding and unwinding the continuous strip from which the wrapping slips are cut, a drive unit being provided to convert the random and continuous flow of cigarettes into a flow of discontinuous ordered groups, a separate drive unit being provided for the unit for forming and feeding the ordered groups of cigarettes, for the unit for transferring each ordered group of cigarettes and combining it with an associated slip, and for the unit for folding the wrapping slip around the ordered group of cigarettes, and at least a third drive unit being provided for the means of unwinding the strip of wrapping material from the reels and of preparing the wrapping slips, these separate drive units being synchronized with each other by mechanical synchronizing means or by means of sensors and detectors connected to control units.

According to an improvement, the means of preparing the wrapping slip comprise means of cutting the slip, also operated by the drive unit of the unit for forming and feeding the ordered groups of cigarettes, the unit for transferring each ordered group of cigarettes and combining it with an associated slip and the unit for folding the wrapping slip around the ordered group of cigarettes.

The advantages of the present invention will be clear from the above description. In addition to the great simplicity of construction, the higher speed of transport, assembly, maintenance and repair, when processes which are substantially identical but in different formats, for example in the case of cigarettes of different lengths or cigarette packs with different numbers of cigarettes, the construction according to the invention enables the processing machine to be adapted simply and speedily to the different specified formats. The prefabricated modular unit structure permits a more rational design of the machine layout. Additionally, for types of processing which require, at least in part, similar or identical units, it is possible to use substantially the same bed and at least some of the drive units, units for transfer and distribution of motion and some processing members which are identical to those of other processing machines, thus facilitating production in respect of both the speed of fabrication and the costs.

The invention also relates to other characteristics which further improve the processing machine described above and which form the subject of the dependent claims.

The particular characteristics of the invention and the advantages derived therefrom are made apparent in greater detail in the description of certain preferred embodiments, illustrated by way of example and without restriction in the attached drawings, in which.

Figure 1A:
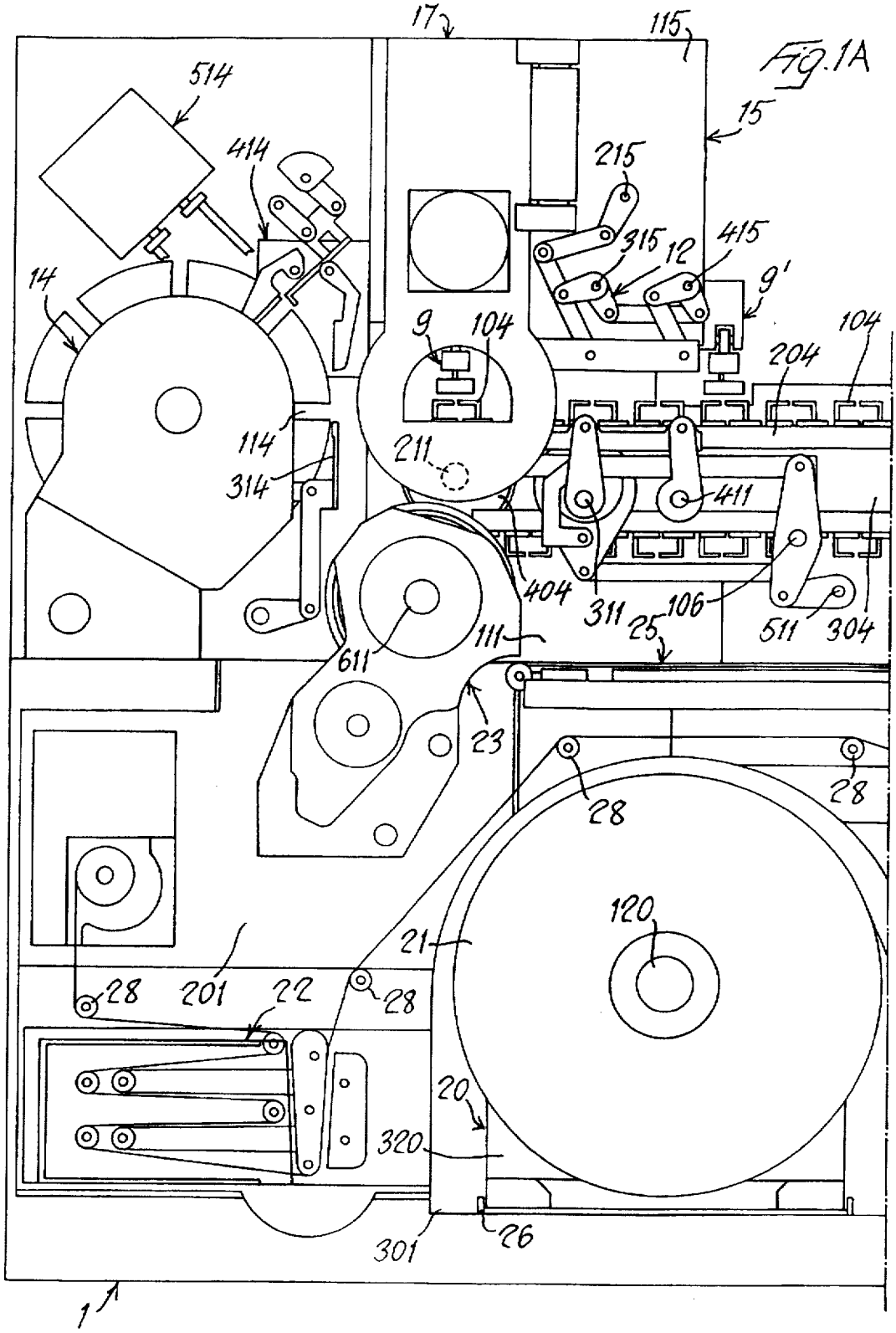
FIGS. 1A and 1B show the front elevation of a cigarette packing machine according to the invention.
Figure 1B:
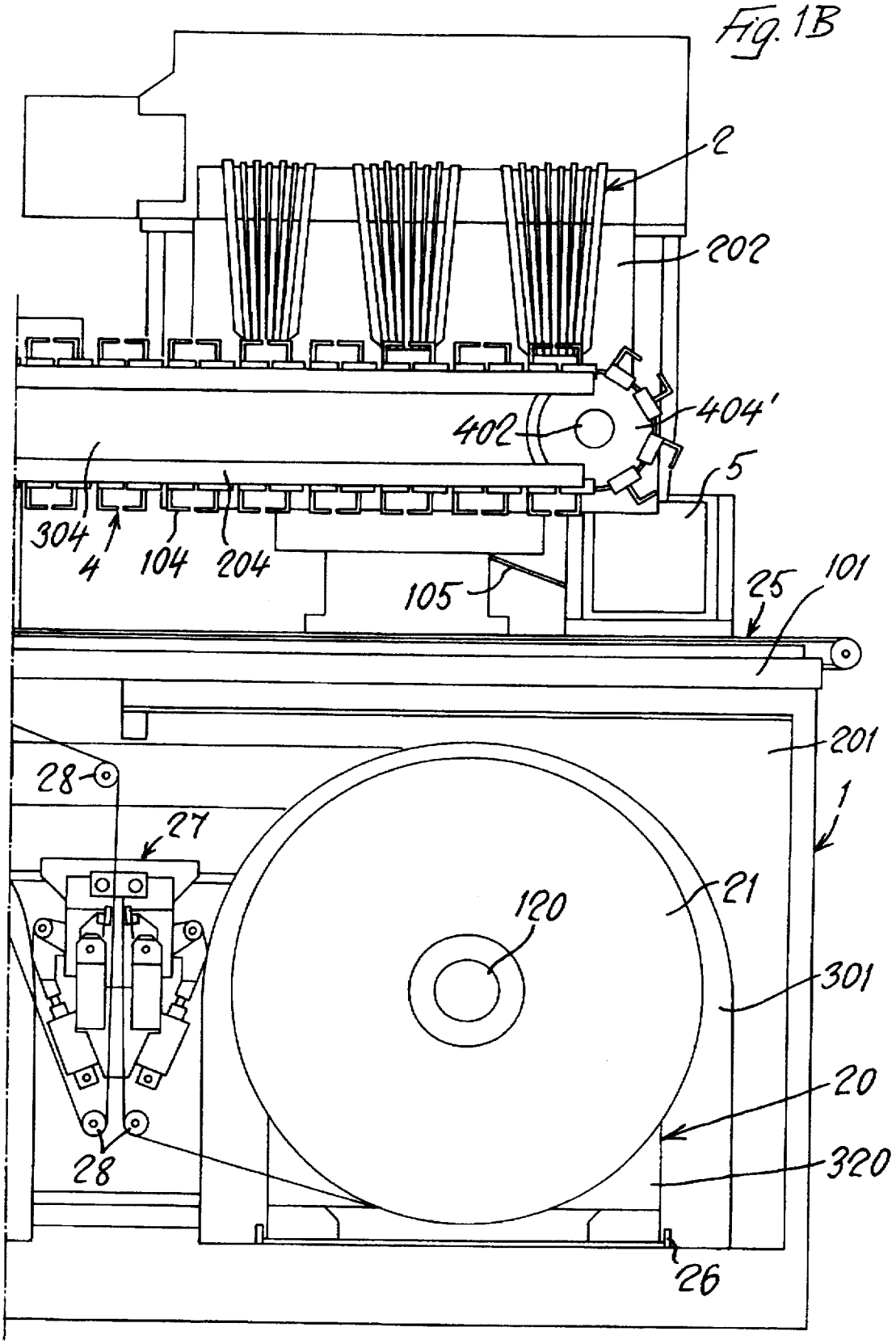

With reference to the figures, a cigarette packing machine, in other words a machine for the formation of ordered groups of cigarettes wrapped in a first wrapping made of tin foil, for example, or other material, consists of a bed 1 which has a top plane 101 which is completely free above. In the area under the plane, the bed 1 has a plurality of recesses 201 or penetrating channels 301.

The cigarettes are fed continuously, randomly and in bulk to a first unit hopper 2 which converts the random and continuous flow into an alternating flow of groups of cigarettes, each ordered in a horizontal row comprising a certain number of cigarettes. The unit 2 comprises a feed hopper 102 into which the cigarettes are fed and which has three outlets, one for each of three rows of cigarettes, adjacent to each other and orientated perpendicular to the front face of the machine. The three rows of cigarettes are disposed on three horizontal planes which are different from each other, and are aligned with each other in a direction parallel to the front face of the bed 1, while the hopper may be provided with means which facilitate the ordered descent of the cigarettes and are driven by a separate motion. The means, which are known and are not illustrated in detail, are integrated with, in other words pre-fitted in, the hopper which in turn is supported by a box 202 housing the means of transmission of the driving motion to the means of controlling the descent of the cigarettes. The unit consisting of the hopper 2 and the box 202 has means of fixing to a predetermined area of the plane 101 of the bed 1. The fixing means are provided in a predetermined position coinciding with predetermined means of engagement of the fixing means in the plane 101 of the bed 1. The fixing means may consist of threaded pins, captive bolts or similar which engage in threaded holes. The fixing means may advantageously be made in such a way as to permit fine adjustment of the position on the plane 101 of the bed 1, and in combination with these the bed 1 and the unit 2 may have preliminary centering means.

Figure 9:
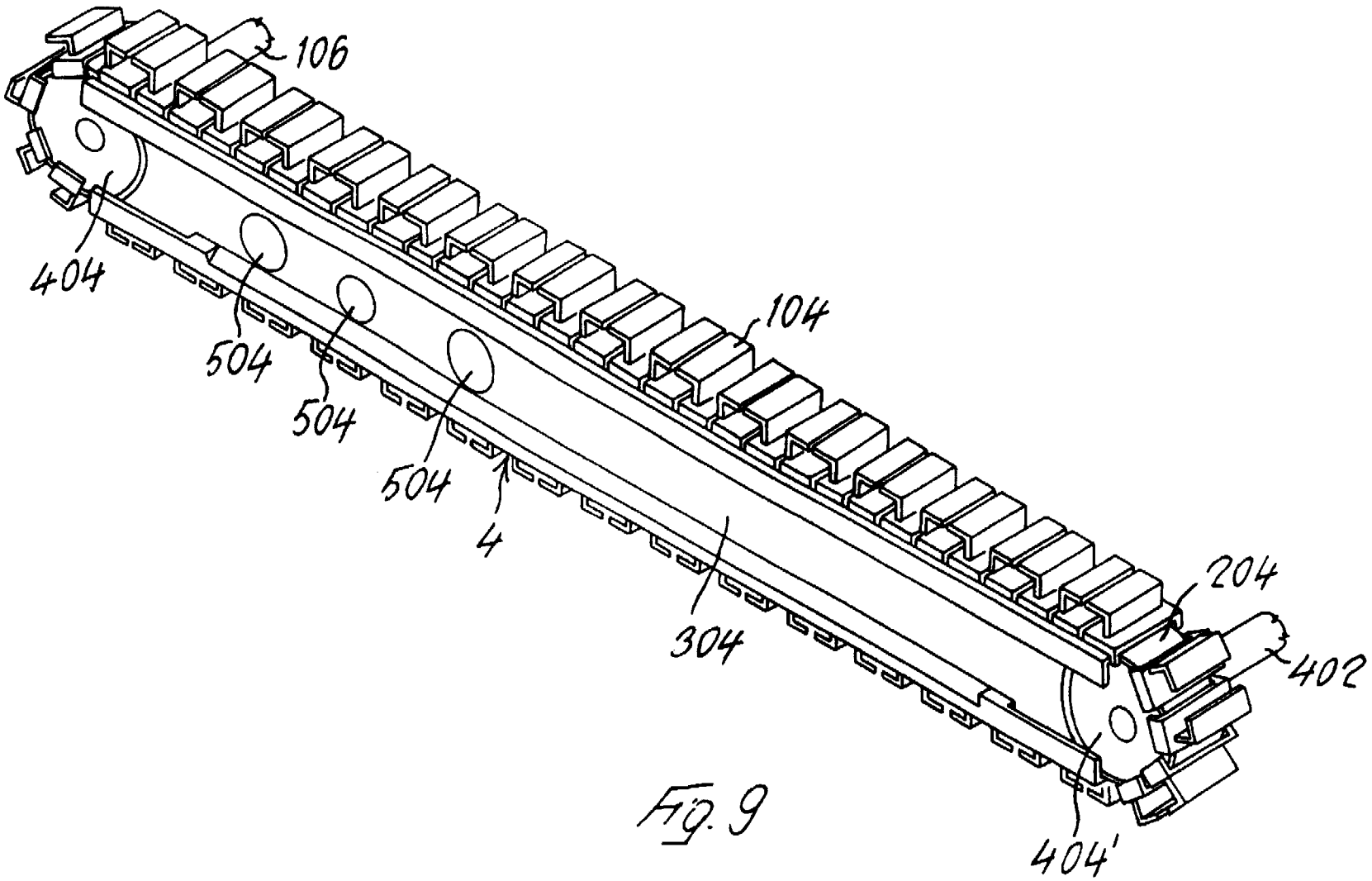
FIGS. 9 to 14 show in detail some prefabricated processing members of the packing machine shown in the preceding figures.
Figure 10:
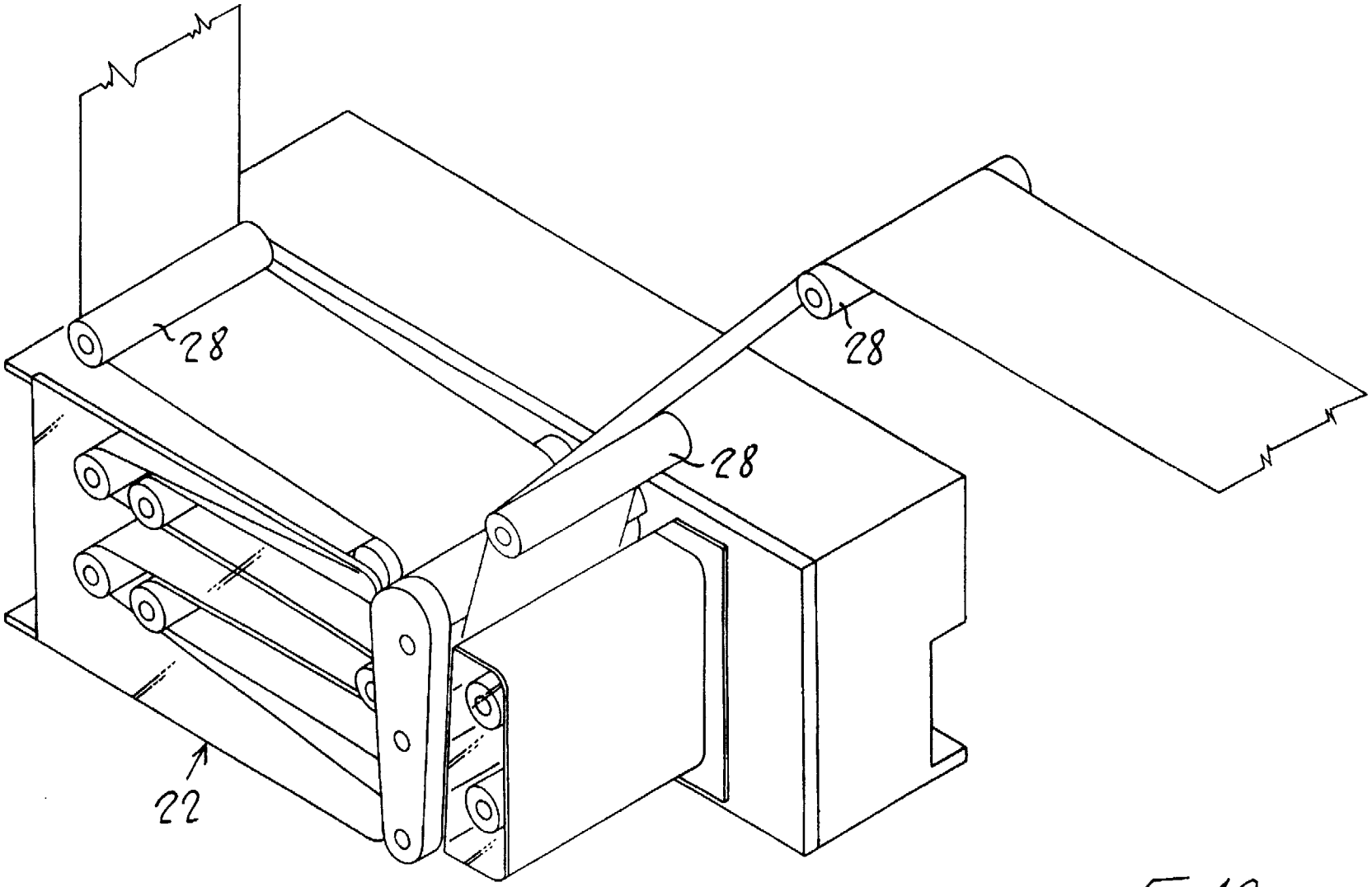

The hopper 2 is aligned on a plane parallel to the front face of the bed 1 which is set back from the bed and interacts with axial means 103 of transferring the cigarettes into a housing 104 of a unit for forming and feeding ordered groups of cigarettes 4 (FIG. 9). The axial transfer means 103, consisting of pushing fingers, are mounted on a pair of adjacent hinged parallelograms 203 which at coinciding points have removable means of coupling to driven shafts 303 and idle shafts 403 projecting from a box 503 of a unit for transfer and distribution of motion 603. The unit 603 is prefabricated and has predetermined means of fixing in a predetermined area of the plane 101 of the bed 1. The hinged parallelograms 203 and the axial transfer means 103 are also pre-assembled and are provided with removable means of fixing on the ends of the shafts 303, 403 of the unit for transfer and distribution of motion 603. The position of the axial transfer means 103 is such that they coincide with through apertures 302 in the box 202 associated with the hopper 2. The drive motion is taken from a driving unit 5 which is also provided with predetermined means of fixing in a predetermined area of the plane 101 of the bed 1. The motion is transmitted to the unit for transfer and distribution of motion 603 by a belt transmission 105 between the shaft of the driving motor 5 and an input shaft of the unit for transfer and distribution of motion 603.

With reference to FIGS. 1A, 1B, 2A, 2B, 8, 9, the unit for forming and feeding ordered groups of cigarettes 4 consists of what is known as a continuous belt 204 which is provided with a plurality of holders 104 orientated coaxially with the cigarettes and transversely to the direction of movement of the belt 204. The direction of movement of the belt is parallel to the front face of the bed 1, while the belt extends in a plane lying in front of the plane formed by the hopper 2, with respect to the front face of the bed 1.

The unit is prefabricated and, with reference to FIG. 9 in particular, comprises a supporting beam 304 which forms longitudinal rectilinear guides for the upper and lower runs of the belt 204 and supports permitting rotation for the end pulleys 404, 404' one of which is driven and one is idle. The two pulleys 404,404' are provided with means of coupling in rotation to corresponding shafts 211, 402. The driving shaft 211 is formed by the output shaft of a unit for conversion, transfer and distribution of motion 11 which also drives other members, while the idle shaft 402 is mounted on and projects from the box 202 of the unit which converts the continuous and random flow of cigarettes into an alternating flow of ordered groups. The idle shaft 402 is associated with the rear end of the belt 204, while shaft 211 is associated with the front end which terminates next to axial means of transferring the cigarettes from the belt 204 to a unit for combining each group of cigarettes with a wrapping slip.

Figure 2A:
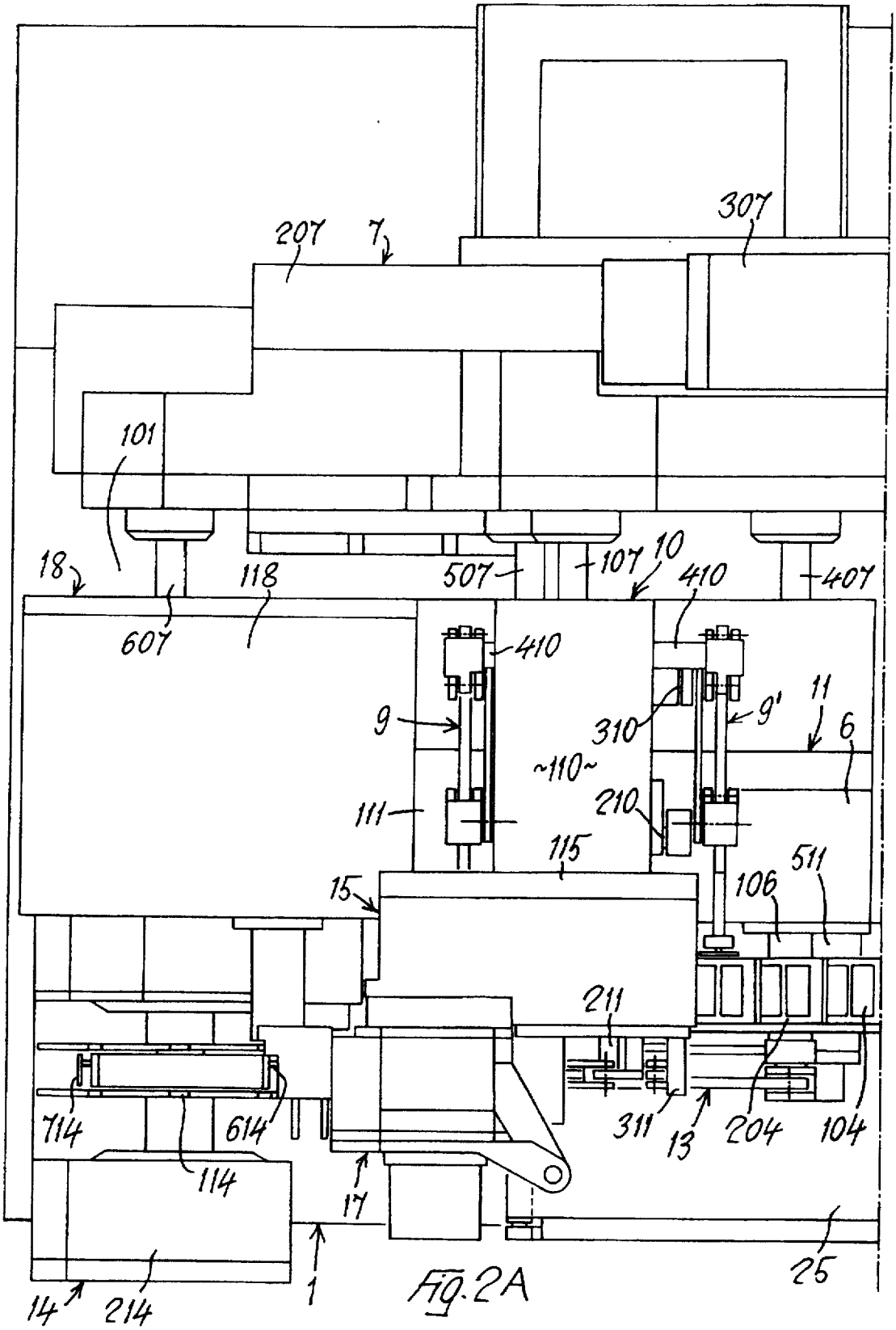
FIGS. 2A and 2B show a plan view from above of the machine shown in FIGS. 1A and 1B.
Figure 2B:
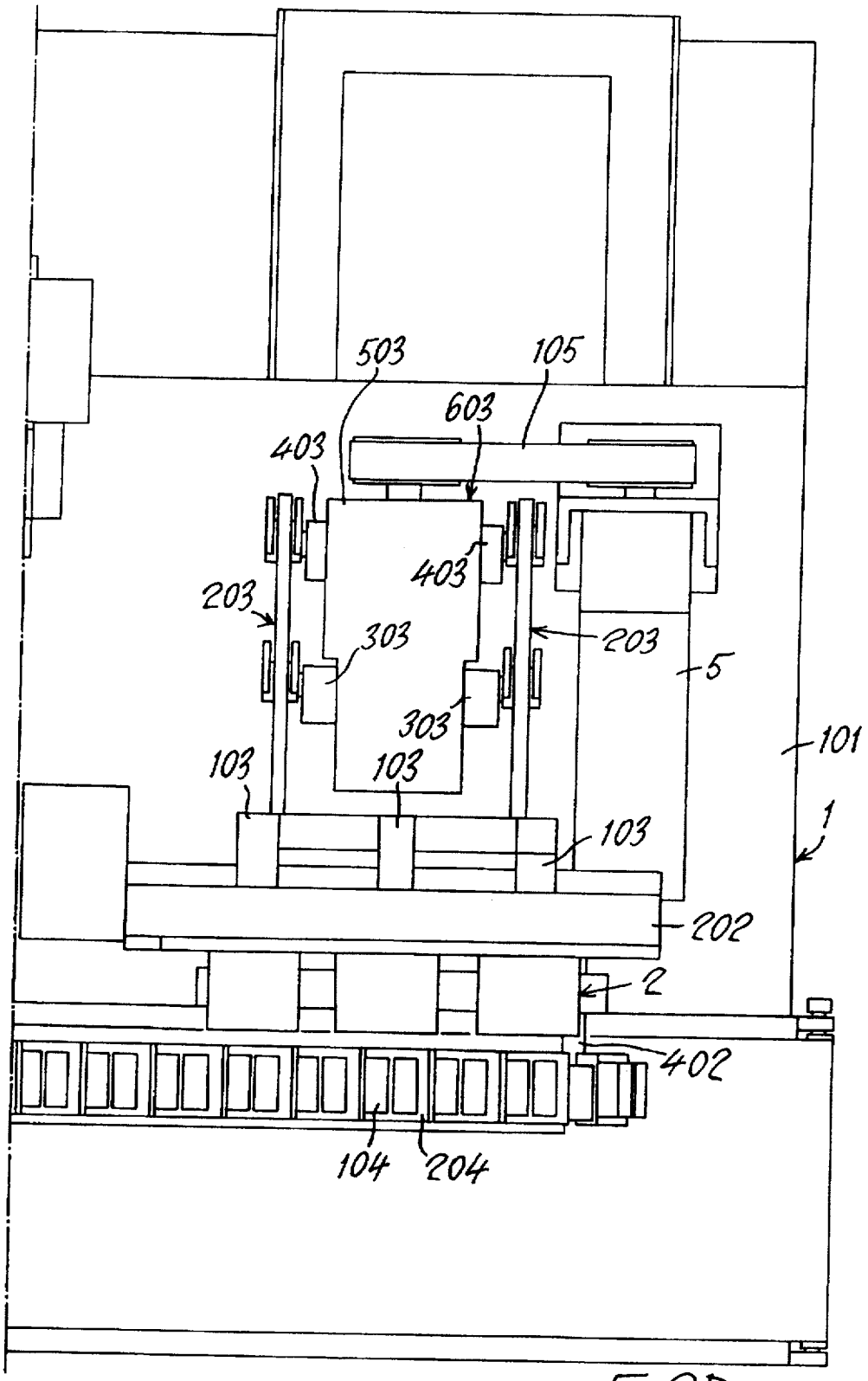
Figure 3:
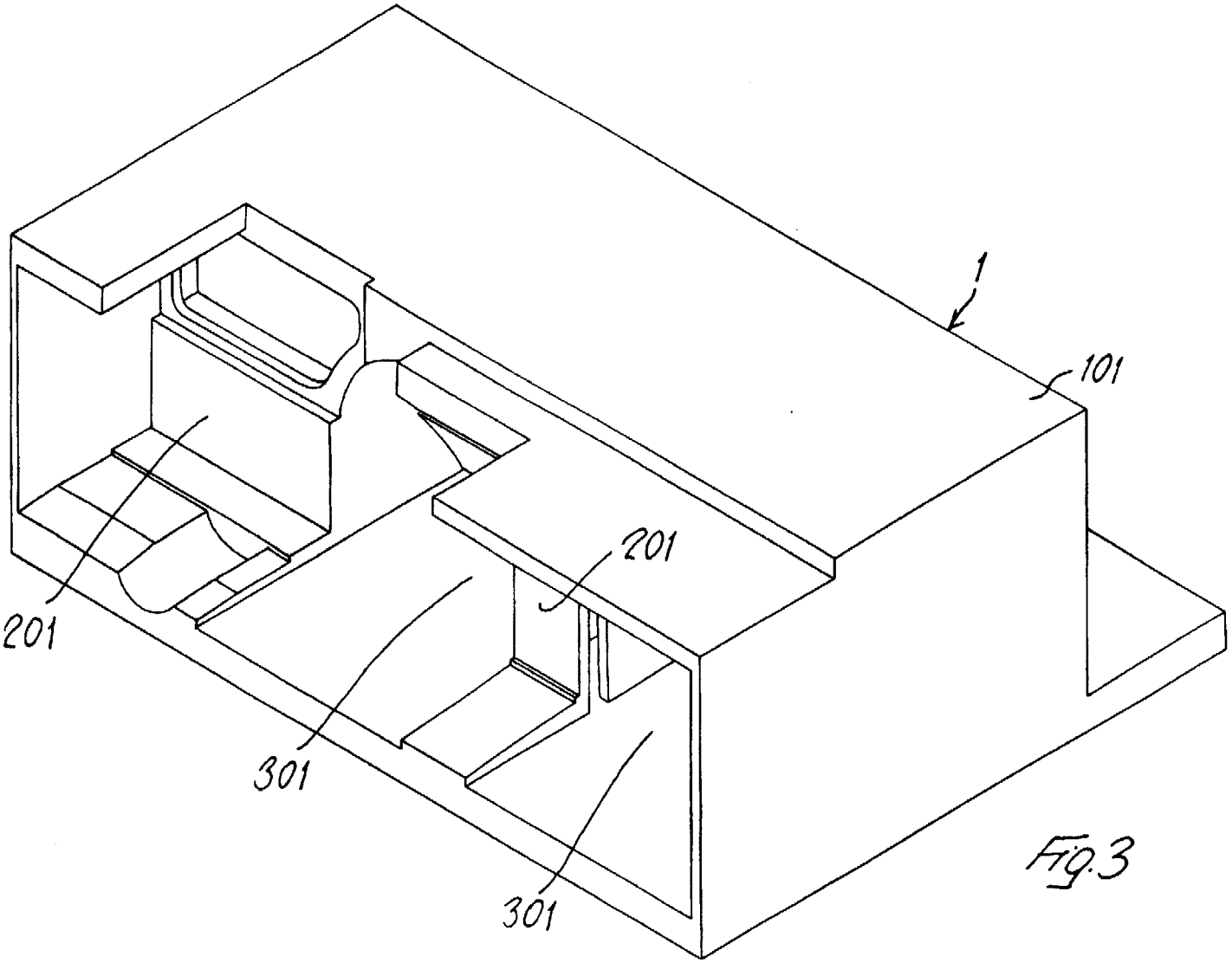
FIG. 3 is a perspective view of the bed forming the base of the machine shown in the preceding figures.
Figure 4:
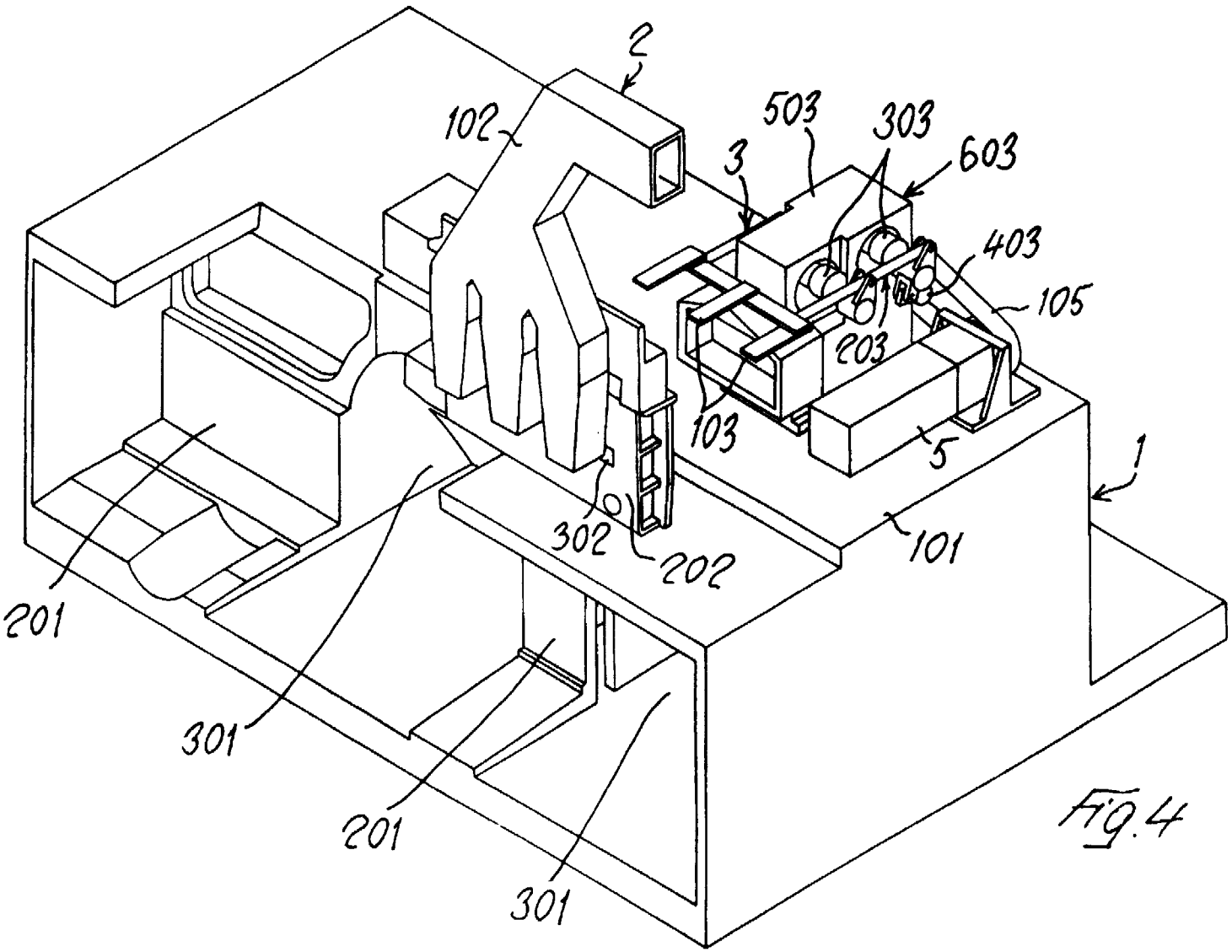
FIGS. 4 to 8 show some partial phases of the assembly of the processing units on the bed shown in FIG. 3.
Figure 5:
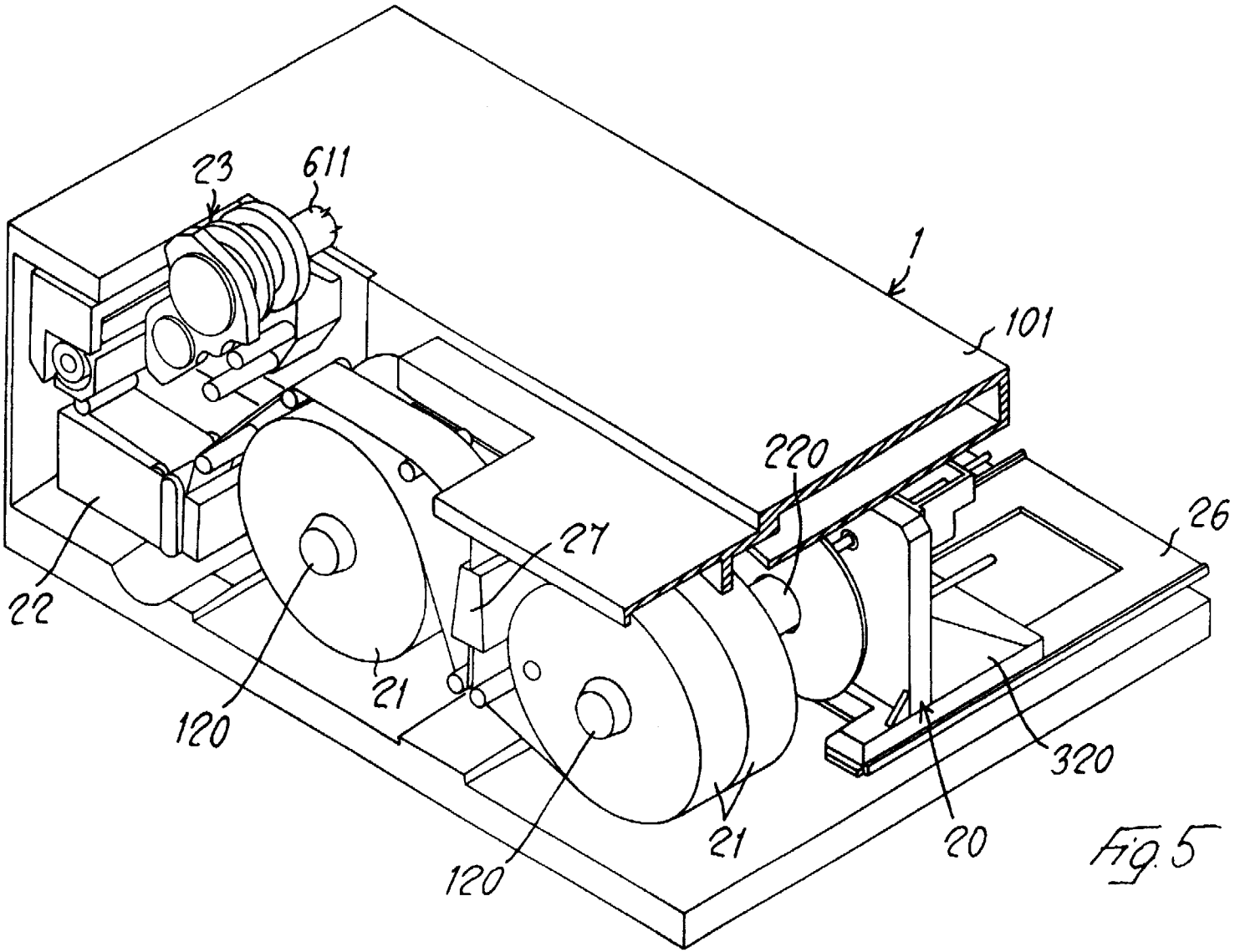
Figure 6:
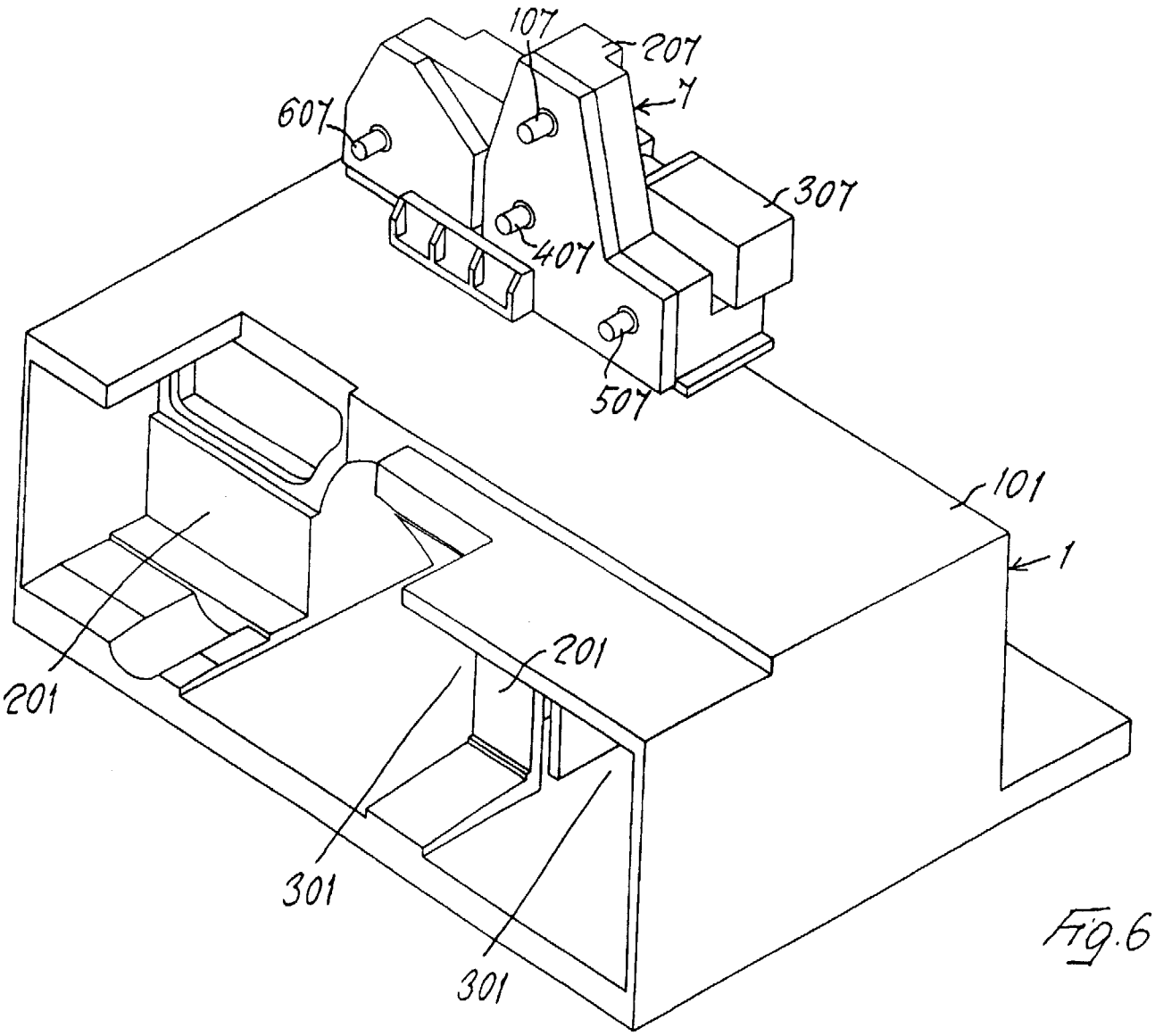
Figure 7:
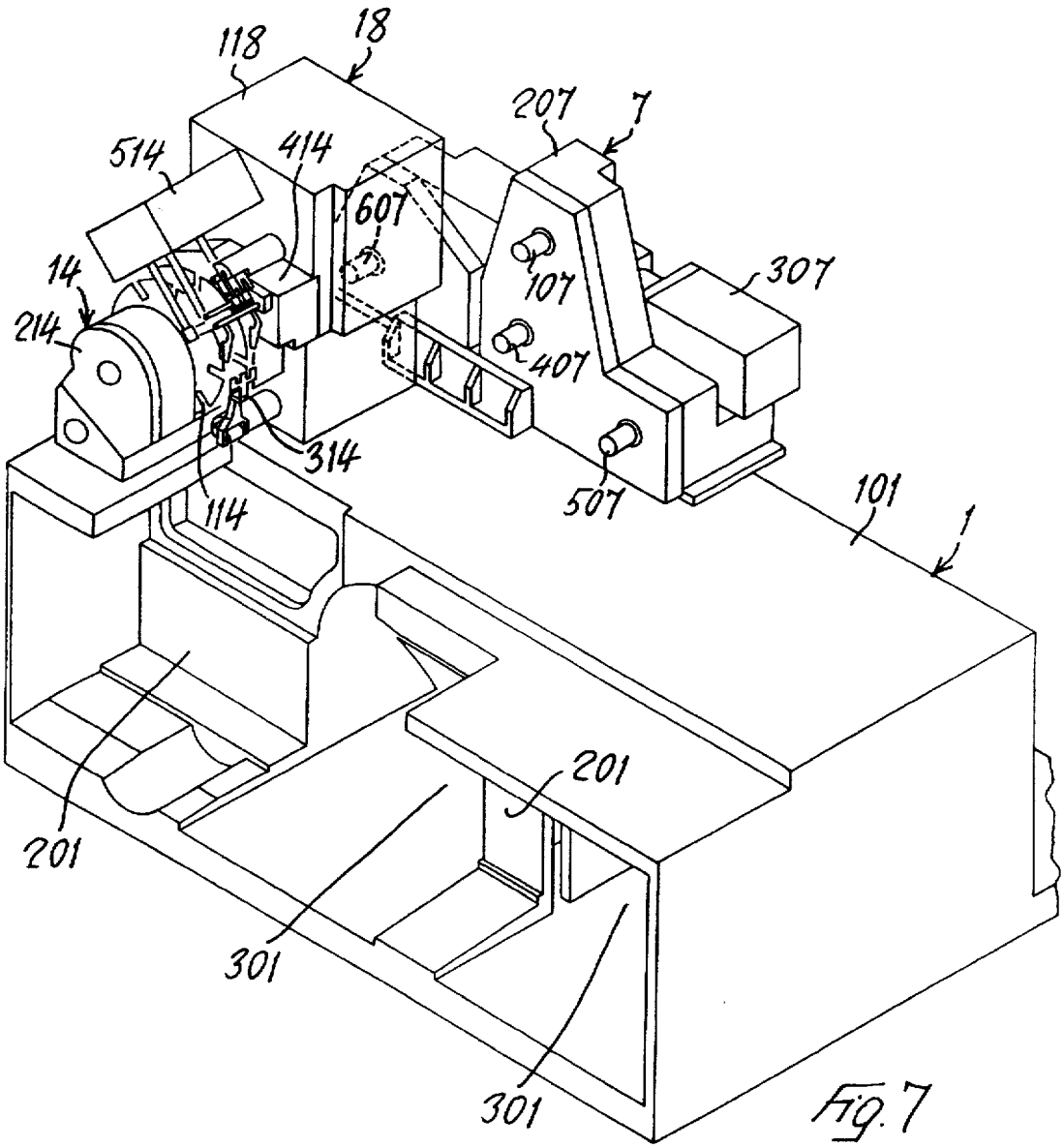

The unit for conversion and distribution of motion 11 which drives the belt 204 with the boxes 104 receives its driving motion directly from the drive unit 7 which is provided in the rear area of the bed 1 (FIG. 2A).

The belt 204 with the boxes 104 terminates at its output end behind a unit for combining each ordered group of cigarettes with a wrapping slip and for transferring them into a subsequent unit for folding the wrapping slip around the group of cigarettes. The beam 304 of the belt 104 has apertures 504 through which shafts 311, 411, 106, which drive the pushing members 13 described below, are made to pass so that they project in a frontal position.

Figure 12:
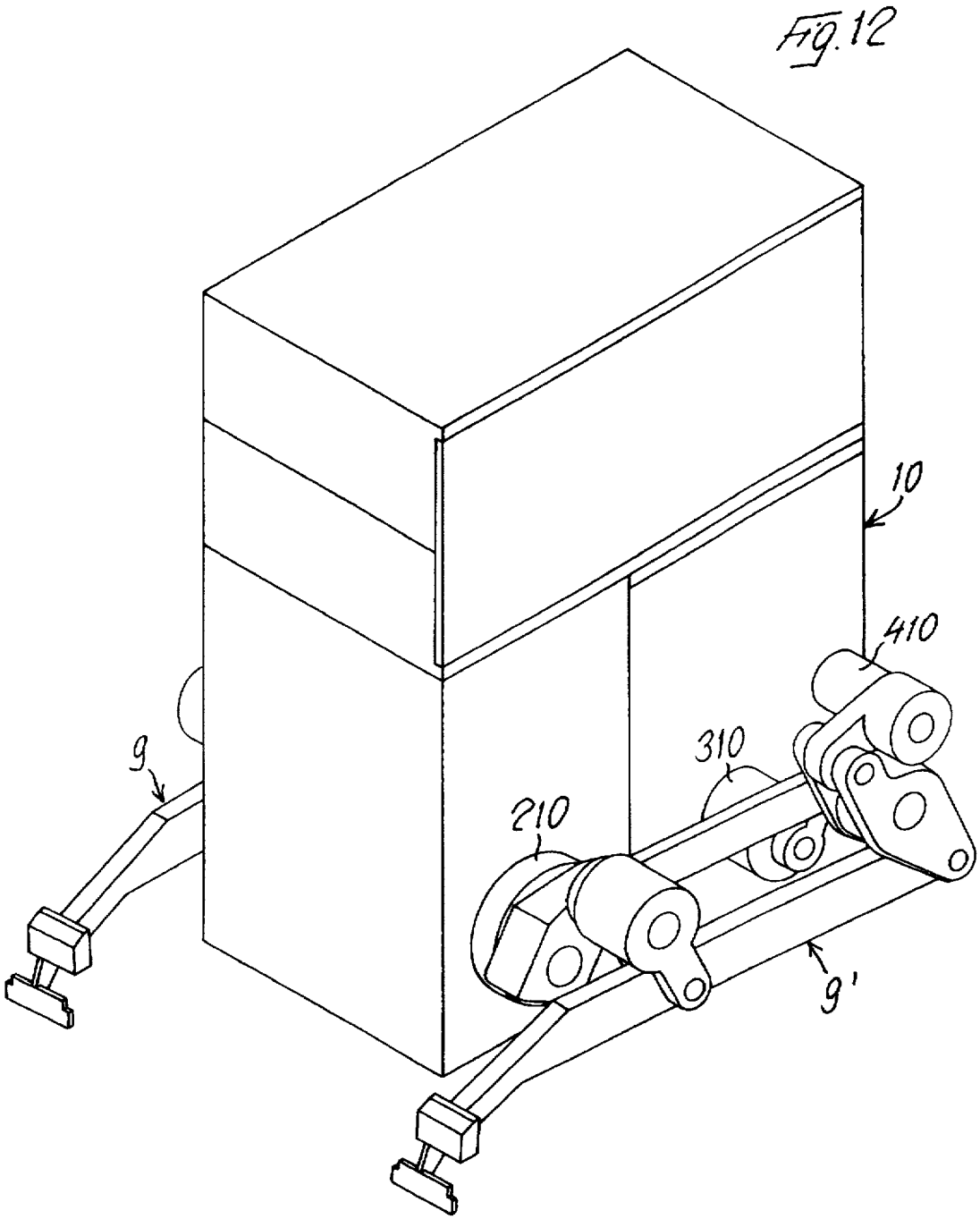

The unit for transferring each ordered group of cigarettes and combining it with a wrapping slip is provided in a plane which is parallel to the belt 204 and which is disposed in a position set forward towards the front face of the bed 1, substantially by a distance corresponding to the maximum axial length of the cigarettes. The transfer and combining unit consists of an axial unit 9 for transferring the cigarettes from the boxes 104 of the belt 204 into a transverse combining and transferring unit. As shown in FIG. 12 in particular, the axial transfer means 9 is made in a form substantially similar to the axial means 3 for transferring the cigarettes into the box conveyor 104. A unit for conversion, transfer and distribution of motion 10 is connected dynamically by removable coupling means projecting on the facing side of a box 110 to an output shaft 107 of the drive unit 7. The shaft 107 projects from the box 207 housing the motor or motors 307 and the transmissions which form the first stages of reduction and/or conversion of the motion and which are integrated into the drive unit 7. The axial transfer unit is made in the form of a preassembled hinged quadrilateral, while the driving shafts 210, 310 and the idle shafts 410, to which corresponding hinging points of the hinged quadrilateral are fixed removably, project from the box 110. Advantageously, the unit for conversion, transmission and distribution of the motion 10 drives a further axial transfer means 9' which is provided before the axial transfer means 9 and which is used to expel defective groups of cigarettes. The axial expulsion transfer means 9' also consists of a hinged quadrilateral substantially identical to that of the axial transfer means 9 and mounted on the same shafts 210, 310, 410 as the axial transfer means 9, with the sole difference that it is provided with a degree of freedom in the vertical direction so that it can be moved between an inactive raised position above the box belt 104,204 and an active expulsion position in which it interacts with the boxes 104 of the belt 204.

Figure 13:
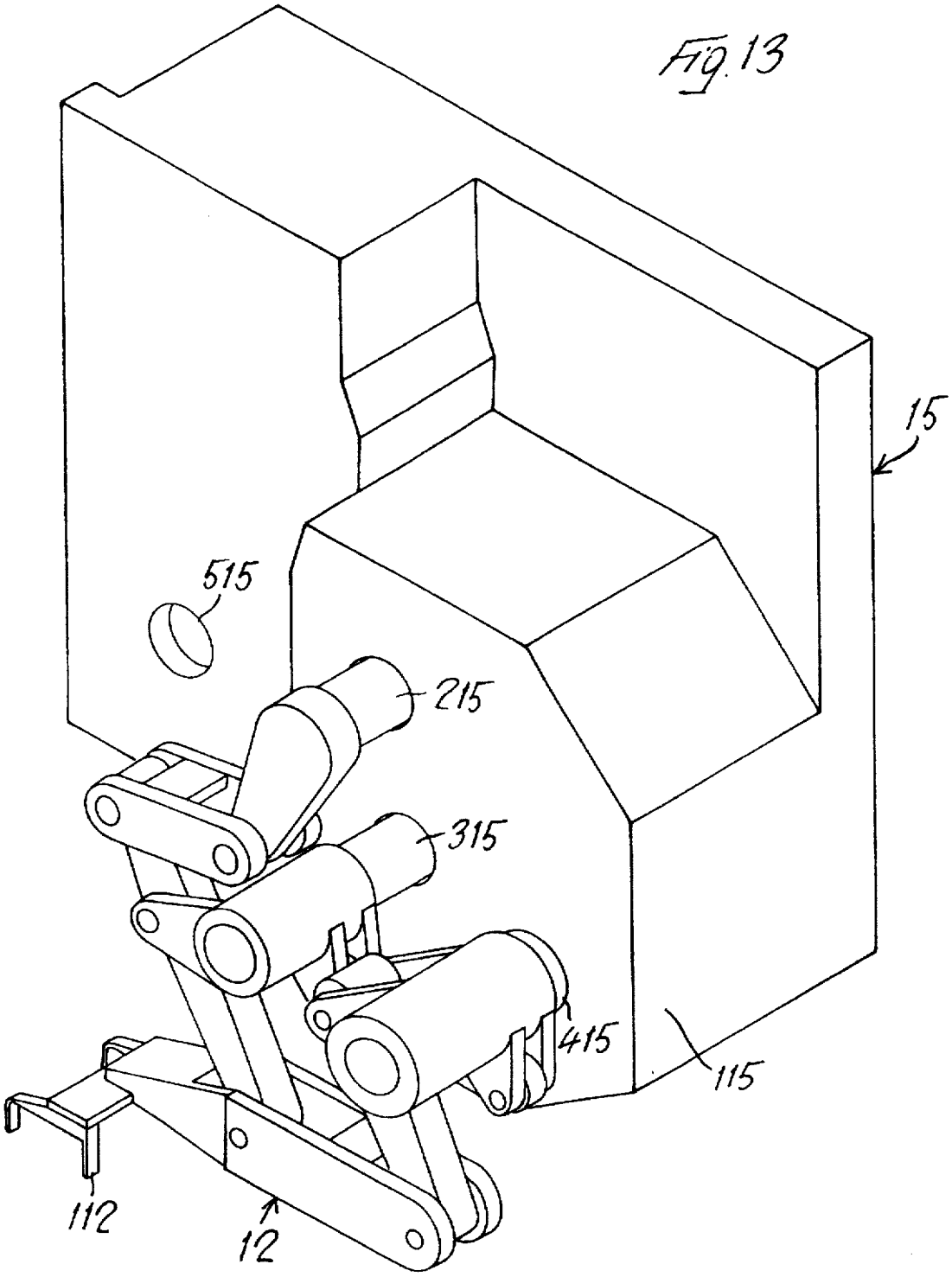
Figure 14:
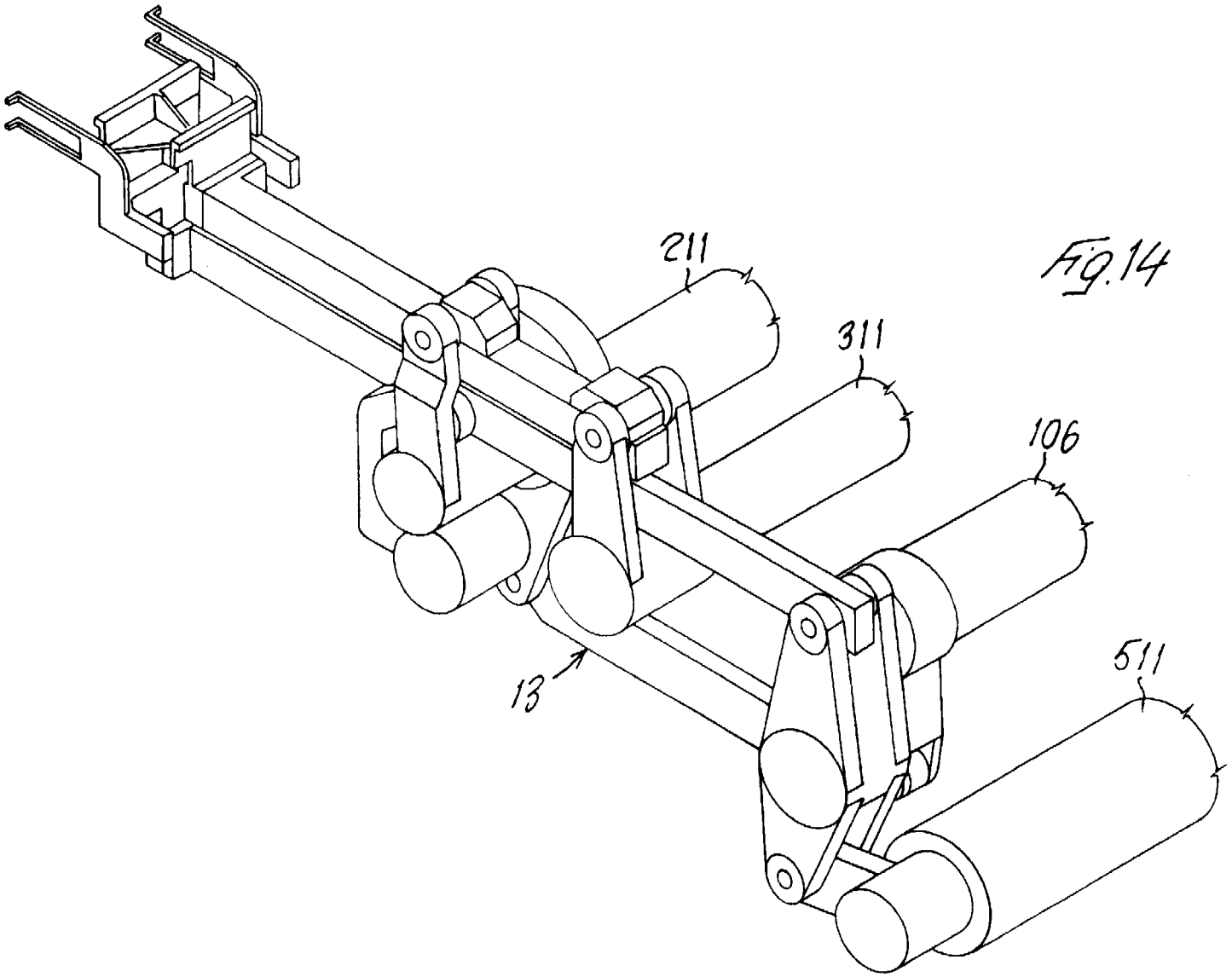

The box 110 of the unit for conversion, transfer and distribution of the motion associated with the axial transfer means 9, 9' is mounted above a further box 111 of a further unit 11 for conversion, transfer and distribution of the motion which is fixed removably to the plane 101 of the bed and which drives the transverse transfer means of the groups of cigarettes. The transfer means are illustrated in detail in FIGS. 13 and 14. The transfer means transfer the individual groups of cigarettes transversely with respect to their axes from the area axially coinciding with the output end of the box belt 104, 204 to a station for combination with a wrapping slip and then into a unit for folding the wrapping slip around the group of cigarettes. The transverse transfer means consist of a transfer member 12 which has means 112 for gripping the group of cigarettes in the form of a holder of inverted U-shape, and which, together with a lower static guide, forms a slidable housing for the group of cigarettes in the station for combination with the wrapping slip, and by pushing members 13 which push the group of cigarettes with the associated wrapping slip from the combining station to a cell 114 of the folding unit 14. Each of the members 12 and 13 consists of a pre-assembled hinged polygon which at predetermined hinging points has means of removable coupling to driven or idle output shafts. The pushing means are coupled to the shafts 311, 411, 511, 106 of the unit for conversion and distribution of motion 11 and of a further unit for conversion, transfer and distribution of motion 6 which is driven by the unit 11. The transverse transfer members 12 are coupled to driven or idle shafts 215, 315, 415 projecting forwards from the box 115 of an associated unit for conversion, transfer and distribution of motion which is fixed to the first box 111 and in front of the box 110 of the unit for conversion and transfer of motion associated with the axial transfer means 9, 9'. The driving motion of the members 12 and 13 is taken from output shafts 407, 507 projecting from the front face of the box 207 of the drive unit 7. The unit for conversion, transfer and distribution of motion 11 associated with the transverse pushing members 13 is connected directly by removable means of coupling to the drive shafts 407, 507, while the unit for conversion, transfer and distribution of motion associated with the transverse transfer members 12 receives its driving motion through the unit for conversion, transfer and distribution of motion 10 associated with the axial transfer means 9, 9'.

Figure 11:
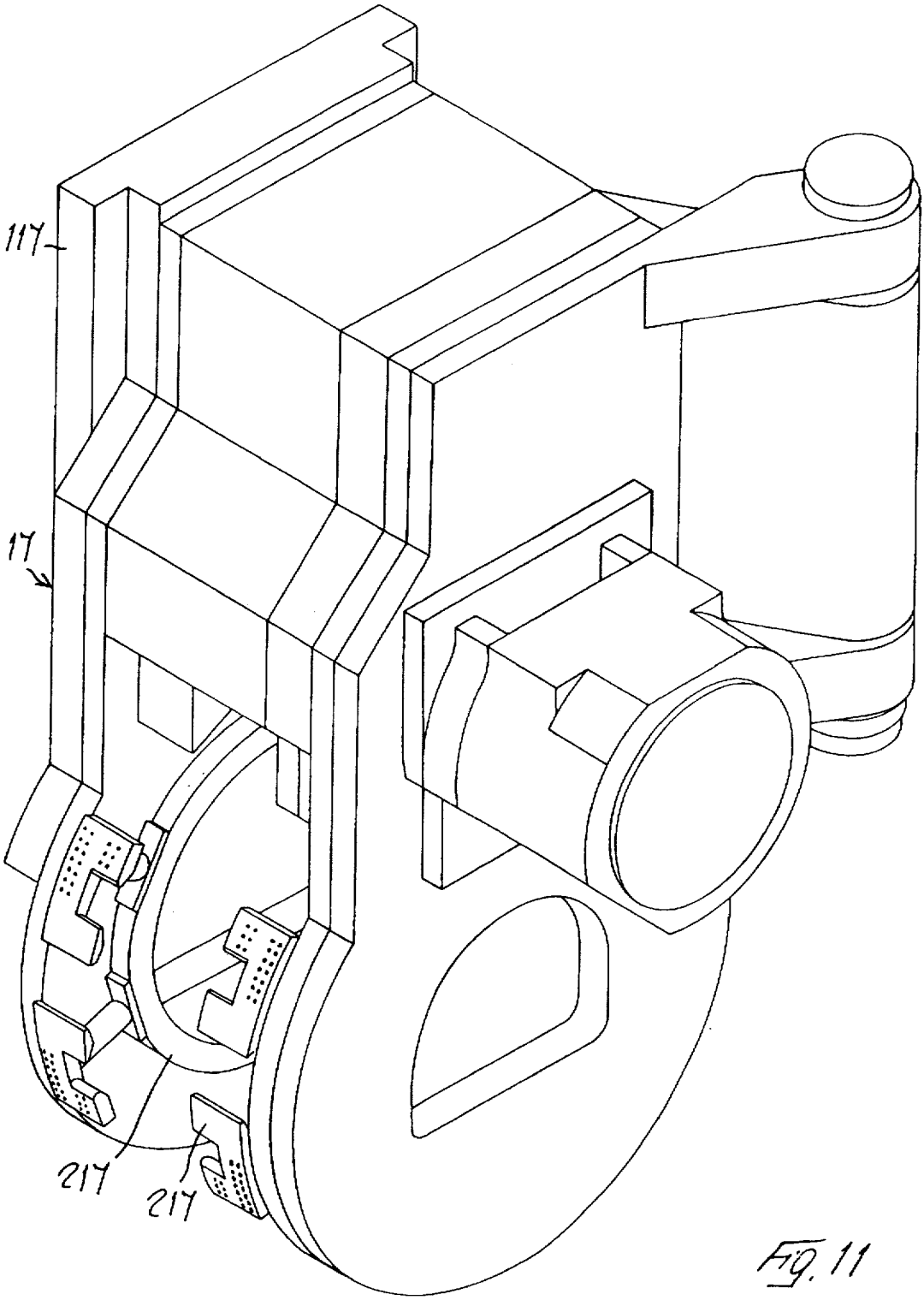

The unit for conversion, transfer and distribution of motion 15 associated with the transverse transfer members 12 also has sources of driving motion 515 for a unit 17 feeding the wrapping slips into the station for combination with the groups of cigarettes. The unit is illustrated in detail in FIG. 11 and has a box 117 which houses two discs with suction sectors 217 which are parallel to each other and are disposed on the two sides of a channel for the passage of the groups of cigarettes. These discs grip the lateral areas of the slips, and hold them transverse to the direction of transfer of the groups of cigarettes. The box 117 also houses the means for the alternating activation of the suction as well as the means for rotating the discs with suction sectors 217.

The unit 17 for feeding the slips into the combining station is also prefabricated and has means of removable coupling to the power sources 515 of the associated unit for conversion, transfer and distribution of motion 15 which are in a predetermined position, as well as predetermined means of removable fixing to the box 115 of the unit 15.

After the station for combining each group of cigarettes with a wrapping slip, there is provided a unit 14 for folding the wrapping slip around the associated group of cigarettes. The folding unit consists of a wheel whose axle extends transversely with respect to the direction of advance of the groups of cigarettes and in a position coinciding with the groups. The wheel has a plurality of radial peripheral cells 114 for the groups of cigarettes and the associated wrapping slips, while it is driven in steps by means of a suitable transmission, particularly one of the Maltese cross type. Means of folding the various sides of the wrapping slip, illustrated schematically in the figures, and formed by means 314 of folding the wrapping slip in such a way as to form a tubular wrapping coaxial with the cigarettes are associated with the wheel in predetermined angular positions, as are means 414, 514 of folding the flaps of the wrapping slip onto the sides of the group of cigarettes corresponding to the ends of the cigarettes. Means 614 of guiding the groups of cigarettes at the time of their insertion by the transverse pushing members 13 into the corresponding cells 114 of the wheel, and means 714 of expelling the groups of cigarettes wrapped in the wrapping slips are also associated with the folding wheel. The folding wheel with the transmission means which control its stepping rotation and the guide means 614 and expelling means 714 and any further means are pre-assembled into a prefabricated operating unit which is fixed to the bed 1 in a predetermined position and which takes the driving motion through means of removable coupling to an output shaft of a unit 18 for conversion, transfer and distribution of the motion. The unit 18 has a box 118 which is disposed on the bed 1 in front of a part of the box 207 of the drive unit 7 and which has an input shaft connected dynamically to means of removable coupling to a power source or to an output shaft 607 of the drive unit 7. The folding means 314, 414, 514 are also made in preassembled form as prefabricated units, and have means of removable coupling to predetermined power sources provided in the unit for conversion, transfer and distribution of the motion associated with the folding wheel 14.

Figure 8:
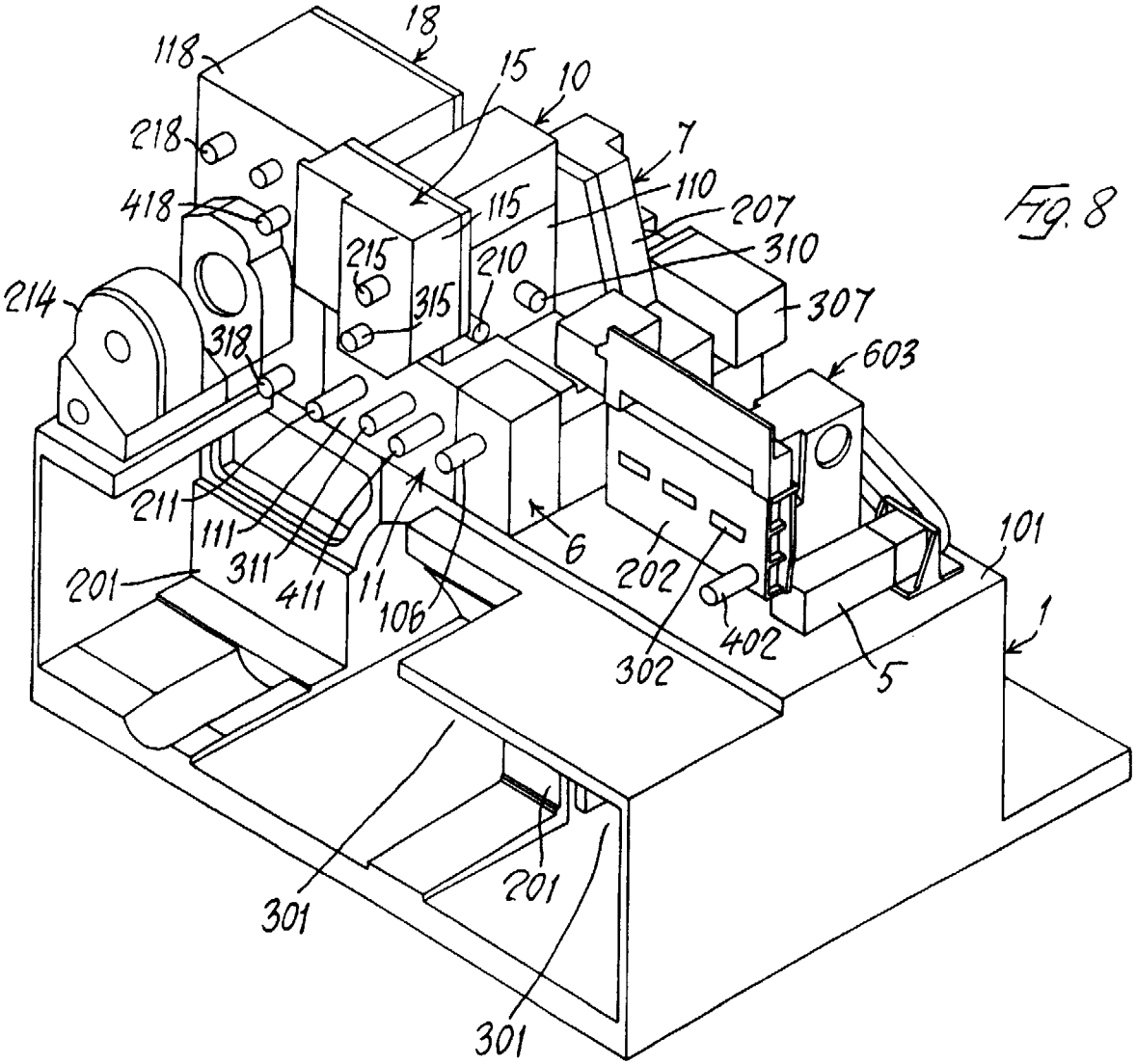

As shown in FIG. 8, the folding means 314, 414, 514 can be coupled to output shafts 218, 318 and 418 of the unit 18 for conversion, transfer and distribution of the motion. Additionally, the folding unit 14, in other words the folding wheel with the transmission which drives its stepping rotation and the guide means 614, the expelling means 714 and other means not illustrated in detail, is integrated in a supporting box 214.

With reference to FIGS. 1A, 1B, 2A, 2B, 5, the means of supporting reels of wrapping material and the means of unwinding the strip from the reels and the means of cutting and preparing the wrapping slips and feeding them to the means 17 of feeding them to the combining station are provided in the area under the plane 101 of the bed 1.

The bed 1 has at least one transverse tunnel, and preferably two parallel transverse tunnels 301, each housing a storage unit 20 which feeds reels of wrapping material strips 21. The feeding storage units may be of any type, and in the illustrated embodiment consist of supporting bars on which the cores of the reels 21 are threaded which are pushed, one after another, onto unwinding shafts 120 on the front ends of the supporting bars 220. Alternatively, it is possible to provide unwinding shafts mounted on manipulators which are supported on slides which can be moved forwards and backwards, to a position for loading a new reel behind the rear of the bed 1, and to an unwinding position substantially corresponding to that illustrated, the manipulators being made in such a way that they can orientate the unwinding shaft so that its axis is in a position suitable for receiving a new reel when the shaft is in a position behind the rear face of the bed 1.

The ends of the two tunnels 301 are set back from the front face of the bed 1 and open into a common recess, in which a unit 27 for automatically joining the tail of a reel becoming used up to the leading portion of a new reel is mounted in an intermediate position. As is clearly shown in FIG. 5, the feeding storage units consist of prefabricated units, each provided with its own supporting frame 320 which is made in the form of a slide and can be engaged with guides 26 for fixing and adjusting the position associated with each tunnel 301. The joining unit is also made in prefabricated form and can be fixed removably in a predetermined position to the bed 1.

A similar construction in the form of a prefabricated unit provided with means of predetermined fixing in a predetermined area of the bed 1 is also provided for an expansion chamber 22 and for a subsequent unit 23 for cutting and preparing the wrapping slips, which is disposed directly below the feeding and guiding unit 17 of the wrapping slips. Whereas the feeding storage units 20 of the reels 21 with the unwinding shafts 120, the automatic joining unit 27 and the expansion chamber 22 are operated by separate motors and synchronized in a non-mechanical way with the remaining drive means, the unit 23 for cutting and preparing the wrapping slip is advantageously driven in a synchronized way by the drive unit 7, being provided with means of removable coupling to an output shaft 611 of the unit for conversion, transfer and distribution of the motion 11.

At the position of the unit 23 for cutting and preparing the wrapping slip, the plane 101 of the bed 1 has a suitable aperture 401, while the unit extends partially beneath and partially above the plane 101.

The return rollers 28 to direct the strips along the predetermined feed paths are also mounted in the recesses 201.

Additionally, according to a further characteristic, the front part of the plane 101 which is provided in a position under the box belt 104, 204 consists of a continuous belt 25 which is run around end rollers perpendicular to the front face of the bed 1. The collecting belt 25 is driven so that it runs in a direction parallel to the front face and extends to the end at the entry end of the path of advance of the cigarettes in the machine, where it discharges the waste which has fallen on to it during processing into a collecting receptacle which is not illustrated in detail. The waste collecting conveyor belt 25 is supported in such a way that its upper run extends substantially flush with the plane 101 of the bed 1.

The units for conversion, transfer and distribution of the motion consist of any type of units for conversion of motion or any type of transmission.

The means for the removable coupling of the input shafts to the power sources may be of any type, such as clutches or similar.

According to a further characteristic, the making of the machine in modules enables the modules, in other words the boxes forming the operating units or the units for conversion, transfer and distribution of the motion to be disposed in such a way as to form tunnels or other types of passage for members disposed at the rear. This is done, for example, in the case of the transverse transferring units 9, which are supported by the unit 10 disposed behind the units 11 and 15; in this case, the unit 15 is disposed in such a way as to form an aperture for a passage.

By constructing the packing machine according to the invention, it is possible to produce a machine layout such that the individual operating parts are always easily accessible both for inspection and for mechanical intervention. Where this access cannot be provided directly, the construction is such that it is easy to provide hatches or similar. The adaptation of the machine to different formats of packs or to different sizes of cigarettes requires only the replacement of the unit 6 which is suitably made in the form of a removable module fixable to the unit 11 and which controls the travel of the transverse pushing means 13, the replacement of the end 112 of the transverse transfer means 12, and the replacement of the forming wheel for adaptation of the shapes of the cells, together with the replacement or adaptation of the unit 17 for combining and feeding the slips and the unit for cutting and preparing the slips.

These operations may be carried out with great rapidity and convenience and without the necessity of substantial dismantling of parts not concerned by the adaptations.

The bed 1 and the individual operating units may easily be used partially if necessary for the fabrication of processing machines which carry out different operations, and in particular, for example, machines for making a paper outer wrapping (for soft packs), cellophane wrapping machines and other machines which are concerned with the handling of cylindrical objects and their wrapping in a material. In these cases, the operating units which are used in the different types of machines can easily be incorporated into the new machines and can easily be combined with new operating units for the specific processing required, thus providing considerable economies in the fabrication of the processing machines.

Naturally, the invention is not limited to the embodiments described and illustrated herein, but may be greatly varied and modified, particularly as regards construction. For example, the individual operating units illustrated may be changed as desired and according to requirements, as may the type of processing machine. All this may be done without departure from the guiding principle disclosed above and claimed below.

I claim:

1. A processing machine which performs various steps of processing comprising:

a bed having an upper support and lower housing beneath said upper support;

first and second drive units mounted to said bed which have respective first and second output members which produce respective first and second driving motions; and a plurality of upper and lower operating units which execute a step of the processing, said upper and lower operating units being synchronized with one another and following a predetermined system of operation, each said operating unit being of modular construction, and including:

a) a conversion unit which converts, transfers and/or distributes an associated one of said first or second driving motions, b) a removable input coupling means for removably connecting an associated one of said first and second output members to said conversion unit, c) an operation member which performs the associated step, d) a removable output coupling means for removably coupling the driving motion connected to said conversion unit to said operation member, and e) a fixing means for removably fixing said operating unit at a predetermined position (i) to said upper support for respective said upper operating units and (ii) to said lower housing for respective said lower operating units.

2. A processing machine as claimed in claim 1:

wherein at least one said drive unit has a plurality of said output members connected by a respective said input coupling means to a respective said conversion unit; and wherein at least one said conversion unit has a plurality of respective said output coupling means coupled to a respective plurality of said operation members.

3. A processing machine as claimed in claim 1 wherein at least one said operating unit includes a second conversion unit and an associated second removable output coupling means for removably coupling the driving motion connected to an associated said conversion unit to said second conversion unit and hence to said operation member associated therewith through an associated said output coupling means.

4. A processing machine as claimed in claim 1 wherein a first said removable input coupling means couples the associated one of said first and second output members to both a first said conversion unit and a second said conversion unit.

5. A processing machine as claimed in claim 1 and further including:

a conveyor which collects waste produced by one or more of said operating units, said conveyor being disposed below the one or more of said operating units and extending horizontally to an end at a side of said bed; and a waste collector provided at said end of said conveyor into which the waste collected and conveyed by said conveyor is dumped.

6. A processing machine as claimed in claim 1:

wherein said bed has a front face and a back face;

wherein said drive units are disposed adjacent said back face;

wherein said conversion units are disposed in an intermediate position between said front face and said rear face; and wherein said operation members are disposed adjacent said front face.

7. A processing machine as claimed in claim 6:

wherein there are first and second parts which are utilized in the various steps of processing;

wherein said first parts are processed in a first direction parallel to a longitudinal direction of said bed extending from an entry side of said bed to an exit side parallel to said front face; and wherein said second parts are processed in a second direction which is towards said front face with individual segments of said second direction being located in horizontal planes out of alignment with each other and adjacent an associated said operation member.

8. A processing machine as claimed in claim 7:

wherein each said first part is a plurality of products;

wherein each said second part is a wrapper for a respective said plurality of products;

wherein said upper operating units process said first parts;

wherein said lower operating units process said second parts; and wherein one of said upper operation units includes an operation member which wraps a respective said wrapper about a respective said group of products.

9. A processing machine as claimed in claim 8:

wherein each said plurality of products is a grouping of cigarettes;

wherein said output members of said drive units project forwardly of an associated said drive unit; and wherein said output coupling means of said upper operating units project forwardly of an associated said conversion unit.

10. A processing machine as claimed in claim 9 wherein at least one said operating unit includes a second conversion unit and an associated second removable output coupling means for removably coupling the driving motion connected to an associated said conversion unit to said second conversion unit and hence to said operation member associated therewith through an associated said output coupling means.

11. A processing machine as claimed in claim 9:

wherein said upper operating units include:

a first feeding unit which feeds cigarettes in an ordered state by converting a random and substantially continuous flow of cigarettes into a stepped flow of groups of cigarettes in a predetermined order;

a forming unit which forms the stepped flow of groups of cigarettes into ordered groups;

a transferring unit which receives each ordered group of cigarettes and combines each ordered group with a wrapping slip; and a folding unit which receives the combined ordered group and wrapping slip and which wraps the wrapping slip about the associated ordered group;

wherein said lower operating units include:

a second feeding unit which feeds wrapping slips from a continuous strip which in unwound from a reel; and an unwinding unit which cuts wrapping slips from the continuous strip provided by said second feeding unit;

wherein said first drive unit drives said first feeding unit;

wherein said second drive unit drives said forming unit, said transferring unit, and said folding unit;

and further including a synchronizing means for synchronizing the drive motions of said first and second drive units.

* * * * *